US011440686B1

(12) United States Patent
Matye

(10) Patent No.: US 11,440,686 B1
(45) Date of Patent: Sep. 13, 2022

(54) HIGH SPEED BAG FILLER

(71) Applicant: DCL, Inc., Charlevoix, MI (US)

(72) Inventor: Reinhard Matye, Charlevoix, MI (US)

(73) Assignee: DCL, Inc., Charlevoix, MI (US)

( * ) Notice: Subject to any disclaimer, the term of this patent is extended or adjusted under 35 U.S.C. 154(b) by 0 days.

(21) Appl. No.: 17/007,210

(22) Filed: Aug. 31, 2020

Related U.S. Application Data

(60) Provisional application No. 62/893,917, filed on Aug. 30, 2019.

(51) Int. Cl.

| | |
|---|---|
| ***B65B 1/06*** | (2006.01) |
| ***B65B 1/32*** | (2006.01) |
| ***B65B 57/14*** | (2006.01) |
| ***B65B 1/22*** | (2006.01) |

(52) U.S. Cl.
CPC ..... *B65B 1/06* (2013.01); *B65B 1/22* (2013.01); *B65B 1/32* (2013.01); *B65B 57/145* (2013.01)

(58) Field of Classification Search
CPC ..... B65B 1/06; B65B 57/145; B65B 1/32; B65B 1/22
USPC ..... 141/314
See application file for complete search history.

(56) References Cited

U.S. PATENT DOCUMENTS

| | | | | |
|---|---|---|---|---|
| 3,735,899 | A | | 5/1973 | Rollinson |
| 3,867,970 | A | | 2/1975 | Winchester, Sr. |
| 4,266,691 | A | | 5/1981 | Wolwowicz |
| 4,378,897 | A | | 4/1983 | Kattelmann |
| 4,594,046 | A | | 6/1986 | Bruder et al. |
| 4,763,702 | A | | 8/1988 | High, Jr. et al. |
| 5,121,775 | A | | 6/1992 | McClain |
| 5,400,837 | A | * | 3/1995 | Kelley ..... B65B 1/32 141/10 |
| 5,425,403 | A | | 6/1995 | Herrmann |
| 5,535,792 | A | | 7/1996 | McGregor |
| 5,632,449 | A | | 5/1997 | Sandolo |
| 5,690,283 | A | | 11/1997 | Sandolo |
| 5,957,172 | A | | 9/1999 | DeGreef et al. |
| 5,957,331 | A | | 9/1999 | Minor et al. |
| 5,979,512 | A | | 11/1999 | McGregor et al. |
| 6,035,606 | A | * | 3/2000 | Bussey, III ..... B65B 43/50 141/314 |
| 6,112,956 | A | | 5/2000 | Malone |
| 6,102,088 | A | | 8/2000 | Wegman |
| 6,158,623 | A | | 12/2000 | Benavides et al. |
| 6,237,309 | B1 | | 5/2001 | DeMarco |

(Continued)

FOREIGN PATENT DOCUMENTS

| | | |
|---|---|---|
| JP | 07-096901 | 4/1995 |

*Primary Examiner* — Jason K Niesz
(74) *Attorney, Agent, or Firm* — Gardner, Linn, Burkhart & Ondersma LLP

(57) ABSTRACT

An apparatus and method are provided for efficient filling of bulk containers with free-flowing bulk materials. The apparatus is configured to support multiple industrial containers and fill them with bulk materials stored in a batching hopper in an effective and expedient manner. The filled bulk material containers are transported away for storage or use. The apparatus includes a rotatable multi-container support assembly for rotating the empty containers into a filling station under the batching hopper. A controller and data logger may be provided to control the apparatus and record the type, quantity and/or weight of each batch of the bulk material dispensed into the industrial containers.

20 Claims, 5 Drawing Sheets

(56) References Cited

U.S. PATENT DOCUMENTS

| | | | | |
|---|---|---|---|---|
| 6,269,849 | B1 | 8/2001 | Fields, Jr. | |
| 6,273,153 | B1 | 8/2001 | Reinsch | |
| 6,298,984 | B1 | 10/2001 | Weaver et al. | |
| 6,474,372 | B2 | 11/2002 | Sanderson et al. | |
| 6,575,208 | B2 | 6/2003 | Sharon et al. | |
| 6,591,875 | B2 | 7/2003 | Zuan et al. | |
| 6,662,528 | B2 | 12/2003 | Holt et al. | |
| 6,776,198 | B1 | 8/2004 | Haines et al. | |
| 6,823,904 | B2 | 11/2004 | Finke et al. | |
| 6,868,650 | B2 | 3/2005 | Sanchez | |
| 6,978,812 | B2 | 12/2005 | Summerville | |
| 7,198,077 | B1 | 4/2007 | Uzkan et al. | |
| 7,267,144 | B2 * | 9/2007 | Nyhof | B65B 1/04 141/114 |
| 8,584,714 | B2 | 11/2013 | Gaultney | |
| 9,010,382 | B2 | 4/2015 | Matye | |
| 9,045,274 | B2 | 6/2015 | Matye | |
| 9,636,843 | B2 | 5/2017 | Matye | |
| 10,173,794 | B2 * | 1/2019 | Breulmann | B65B 39/007 |
| 2002/0074055 | A1 | 6/2002 | Sanderson et al. | |
| 2003/0019541 | A1 * | 1/2003 | Bassi | B65B 43/465 141/114 |
| 2003/0062096 | A1 | 4/2003 | Zuan et al. | |
| 2004/0007285 | A1 | 1/2004 | Finke et al. | |
| 2008/0016825 | A1 | 1/2008 | Mandzsu, Sr. et al. | |
| 2008/0156394 | A1 * | 7/2008 | Vollenkemper | B65B 39/002 141/114 |
| 2010/0118640 | A1 | 5/2010 | Matye et al. | |
| 2011/0041952 | A1 | 2/2011 | Gaultney | |

* cited by examiner

HIGH SPEED BAG FILLER

CROSS REFERENCE TO RELATED APPLICATION

The present application claims the priority benefit of U.S. provisional application Ser. No. 62/893,917, filed Aug. 30, 2019, which is hereby incorporated herein by reference in its entirety.

FIELD OF THE INVENTION

The present invention relates generally to packaging equipment, and in particular, to machinery for filling bulk bags or other containers with bulk materials.

BACKGROUND OF THE INVENTION

Bag filling machines are used to reduce labor costs and minimize time required to dispense bulk material into bags or containers. Such bags or containers may be used to temporarily store loads of sand, gravel, grain, or the like, or may be used in more long-term applications such as sand bags used for reducing erosion along bodies of water. Although typically faster than manual filling of bags by individuals, bag filling machines can be somewhat slow and cumbersome in operation, and may not be capable of uninterrupted and continuous bag-filling processes. Bag filling machines may be particularly slow in operation when handling large and heavy bulk bags filled with materials like sand and gravel.

SUMMARY OF THE INVENTION

The apparatus and method of the present invention provide for an easy-to-operate system and efficient bulk bag or container filling or loading production process that employs a multi-ended rotary fork assembly that supports multiple bulk bags. The apparatus includes a rotational drive system that enables the rotary fork to rotate or pivot about an axis to facilitate the filling and replacement of filled bulk bags, substantially without time consuming interruptions in the process associated with handling. The apparatus may include a retractable spout assembly that extends downwardly from a hopper toward a bulk bag for filling the bag with bulk material. Optionally, the hopper may be a batching hopper that pre-weighs the material prior to dispensing a desired amount thereof.

In one form of the present invention, an apparatus for filling a bulk bag with bulk material includes a frame and a batching hopper supported by the frame. The batching hopper is designed for holding the bulk material to be dispensed into the bulk bag. The apparatus includes a multi-bag support assembly having a generally horizontally-oriented multi-bag support and a generally vertically-oriented rotary structure for rotating the multi-bag support. Optionally, the apparatus includes a fill spout assembly extending downward beneath the batching hopper. The fill spout is designed to direct the bulk material into the bulk bag during the filling.

In one aspect, the rotary structure has a rotational drive system including a drive sprocket that enables that rotary structure to axially rotate about its longitudinal axis. A structural arrangement firmly secures the rotary structure to the multi-bag support.

In another aspect, the apparatus has a roller deck for supporting the filled bulk bags. The roller deck includes a roller conveyor for discharging the bulk bags after filling. Optionally, the roller deck also includes a pallet dispenser and a retractable vibrating grid for densifying the bulk material dispensed into the bulk bag. The vibrating grid may include a timer control.

In a further aspect, the batching hopper defines an opening for receiving the bulk material, and may serve as a weighing bin for weighing a batch of the bulk material prior to dispensing the bulk material into the bulk bag. The batching hopper includes an actuatable closure that is configured to selectively dispense the bulk material into the bulk bag.

In a still further aspect, the batching hopper includes a controller that is configured to transmit to a central programmable logic controller (PLC) weight information of the batch of the bulk material being dispensed, or weight information of the batching hopper indicating that the batching hopper is empty.

In a further aspect, the multi-bag support includes a generally horizontal frame. The horizontal frame has a release mechanism on each end of the horizontal frame. The release mechanism is designed to selectively hold and release the bulk bag.

In yet a further aspect, the apparatus further includes a dust collector for extracting airborne particles of the bulk material during dispensing of the bulk material into the bulk bags, and recycling it back into the batching hopper for a new batch of the bulk material to be dispensed.

According to another form of the present invention, a method for filling a bulk bag with bulk material includes installing a first bulk bag on a first end of a multi-bag support assembly, filling a batching hopper with a predetermined amount of bulk material, weighing the bulk material with a weight scale of the batching hopper, rotating the first bulk bag in a fill position under the batching hopper, engaging a fill spout assembly to direct the bulk material into the first bulk bag, dispensing the bulk material into the first bulk bag, installing a second bulk bag on a second end of the multi-bag support assembly, discharging the first bulk bag from the fill position, and rotating the multi-bag support assembly about a longitudinal axis of a rotary structure of the multi-bag support assembly to position the second bulk bag in the fill position.

In one aspect, the method further includes lifting a vibrating grid of a roller deck under the first bulk bag, engaging the fill spout assembly, opening an actuatable closure to selectively dispense the bulk material after weighing of the batch, weighing the batching hopper and, in response to an indication that the batching hopper is empty, closing the actuatable closure, transmitting the indication that the batching hopper is empty by a controller of the batching hopper to a central programmable logic controller (PLC).

In another aspect, the method further includes discharging the first bulk bag from the fill position, placing an empty pallet under the batching hopper, rotating the multi-bag support assembly to position the second bulk bag on the empty pallet under the batching hopper and in the fill position, filling the batching hopper with the predetermined amount of bulk material, engaging the fill spout assembly to direct the bulk material into the second bulk bag, installing a third bulk bag on another end of the multi-bag support assembly, dispensing the bulk material into the second bulk bag, discharging the second bulk bag from the fill position, and rotating the multi-bag support assembly about the longitudinal axis of the rotary structure to position the third bulk bag in the fill position.

Thus, the present invention provides an apparatus and method for high speed filling of a plurality of bulk bags or other objects with predetermined amounts of bulk material, discharging the filled bags via a conveyor line of the apparatus, and rotatably placing another bulk bag in a fill position by implementing a multi-bag support assembly of the apparatus of the present invention, thereby increasing speed and efficiency associated with packaging and handling of the filled bulk bags.

These and other objects, advantages, purposes and features of the present invention will become apparent upon review of the following specification in conjunction with the drawings.

DETAILED DESCRIPTION OF PREFERRED EMBODIMENTS

Figure 1:
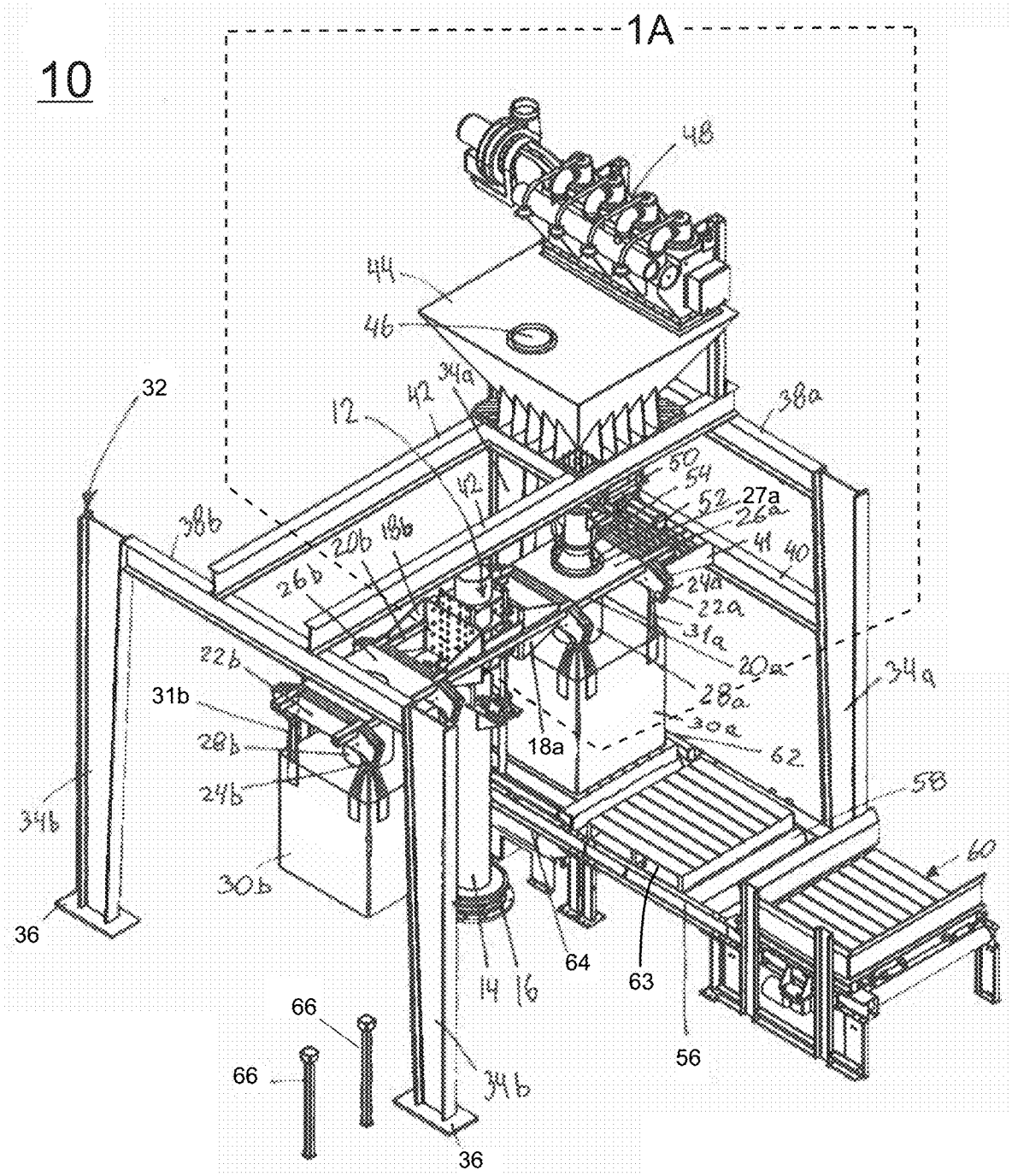
FIG. 1 is a perspective view of an apparatus for high speed bulk bag filling, in accordance with the present invention.
Figure 3:
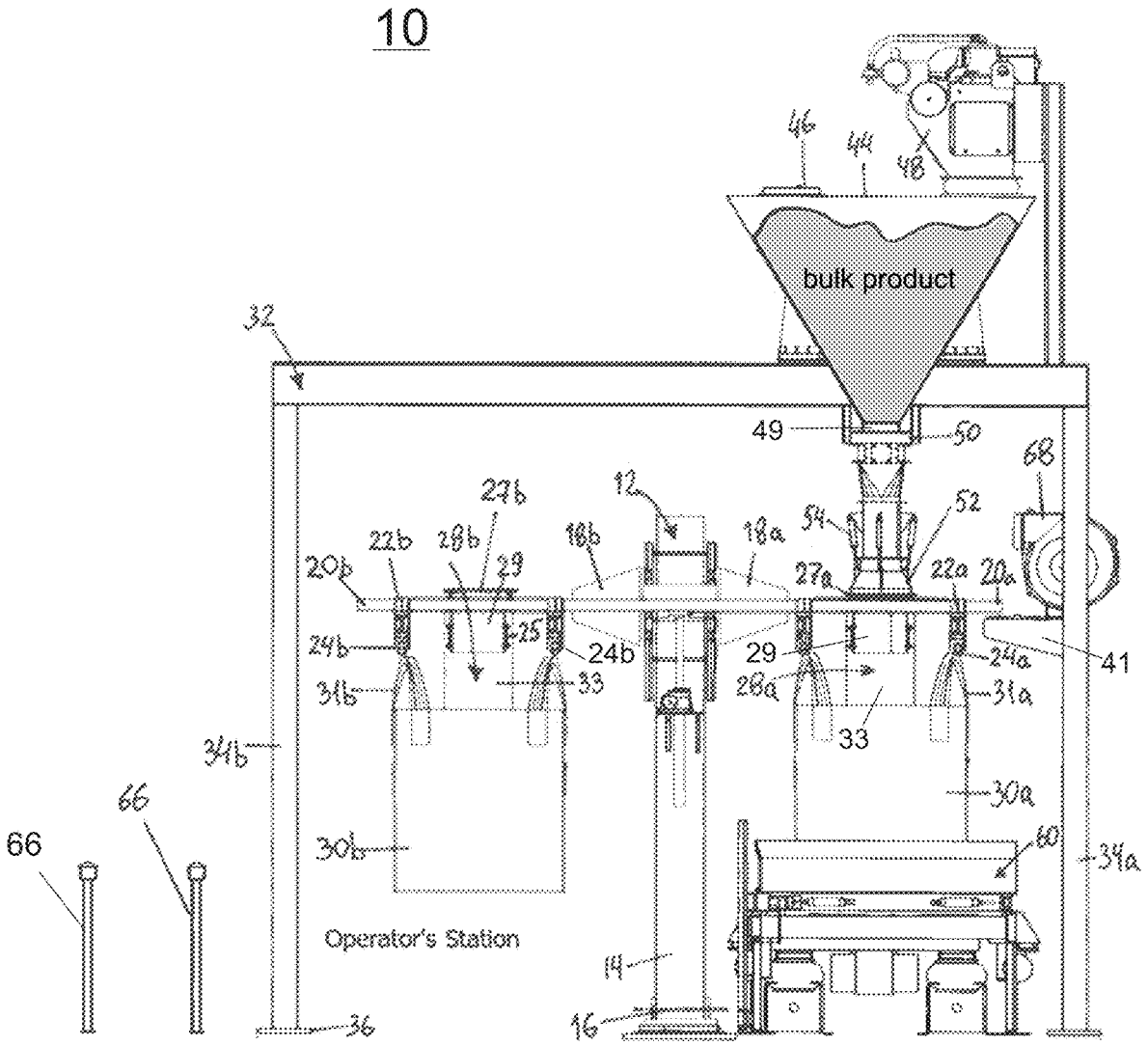
FIG. 3 is a front elevation of the apparatus illustrated in FIG. 1.
Figure 4:
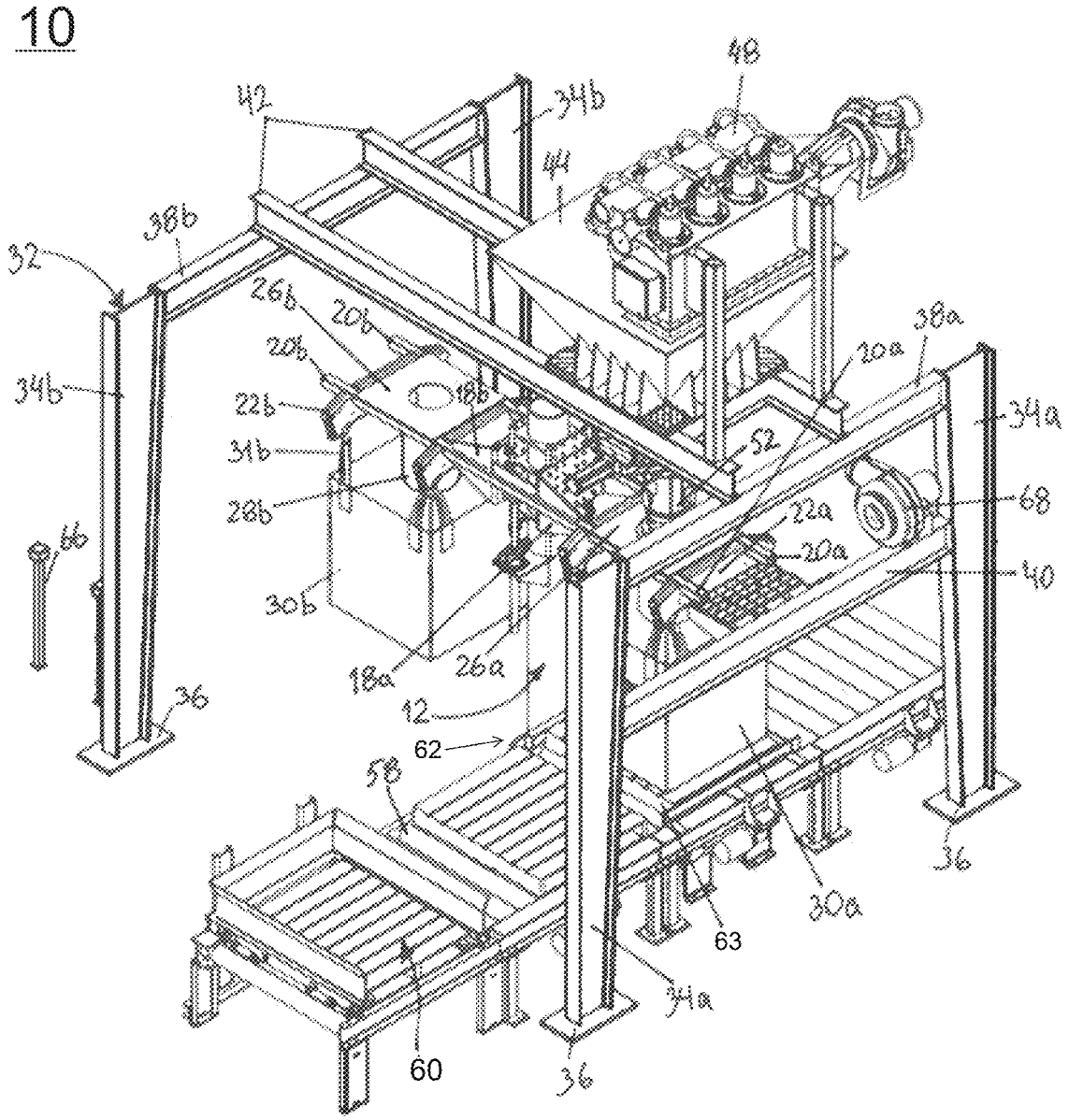
FIG. 4 is another perspective view of the apparatus illustrated in FIG. 1.

Referring now to the drawings and the illustrative embodiments depicted therein, a filling machine 10 is provided for efficient filling of a plurality of bulk bags 30*a*, 30*b* with bulk material, such as shown in FIG. 1. The filling machine 10 includes a multi-bag support assembly 12 with a rotary post 14 and a multi-bag support fork 20, a frame 32, a bulk material supply structure in the form of a batching hopper 44 supported by the frame 32, a fill spout assembly 52 extending downwardly from the hopper 44, and a roller deck 56. Referring to FIGS. 1, 3 and 4, the multi-bag support fork 20 supports a pair of bulk material bags 30*a* and 30*b*. In the illustrated embodiment, the rotary post 14 is a generally vertical structure that carries the load of supporting the multi-bag support fork 20 and bags 30*a*, 30*b* suspended therefrom. It should be appreciated that the rotary post 14 may be a robotic arm or suitable other structure, at least a portion of which is generally in a vertical or upright orientation in relation to the floor, suitable to support heavy weights and able to pivot about its vertical axis. In the illustrated embodiment, rotary post 14 has a rotational drive system 16 including a drive sprocket and chain that causes the rotary post 14 to axially rotate back-and-forth, such as by changing direction or each rotation or by rotating in the same direction, so as to position the empty bulk bag at the filling position. The rotary post 14 may rotate about 180 degrees about its longitudinal (vertical) axis when configured as shown in the illustrated embodiment, or may rotate by a sufficient degree so as to position the empty bulk bag at the filling position for a given station configuration. It should be appreciated that the rotational drive system may be implemented by a plurality of various means including mechanical, hydraulic, or electrical apparatus capable of rotating the rotary post 14 by at least about 90 to 360 degrees about its vertical axis to achieve the desired bag positioning for the selected station configuration.

The multi-bag support fork 20 has a pair of opposite ends 20*a*, 20*b* (FIGS. 1, 3 and 4), and is secured to rotary post 14 by a structural arrangement including a pair of opposite brackets 18*a*, 18*b* for holding the respective opposite ends 20*a*, 20*b* of the multi-bag support fork 20. In the illustrated embodiment, best depicted in FIGS. 1 and 4, rotary post 14 and multi-bag support fork 20 are oriented generally perpendicular to one another, and the multi-bag support fork 20 is oriented generally parallel to the floor. It should further be understood that multi-bag support fork 20, illustrated in FIGS. 1 and 4 as having a pair of generally parallel rods or bars extending in opposite directions from rotary post 14, could be formed as a frame, a rack, a rod, a fork, a structure having an oval, circular, rectangular, or square shape, or any other structure having at least two ends or portions extending in opposite directions from rotary post 14. As seen in greater detail in FIGS. 1 and 3, the opposite ends 20*a*, 20*b* of multi-bag support fork 20 perform the same functions of supporting respective bags 30*a*, 30*b*, except that in one position the first end 20*a* supports the first bag 30*a* for filling, while the second end 20*b* is ready to receive an empty second or replacement bag 30*b*, or is already supporting or suspending an empty replacement bag 30*b*.

Each end 20*a* and 20*b* of multi-bag support fork 20 includes a respective pair of generally parallel latching arms 22*a* and 22*b* that releasably hold respective bags 30*a*, 30*b* by their respective lifting straps 31*a* and 31*b*. In the illustrated embodiment, the first pair of latching arms 22*a* is secured to the first end 20*a*, and the second pair of latching arms 22*b* is secured to the second end 20*b*. In the exemplary embodiment, best seen in FIGS. 1 and 3, to releasably hold respective bags 30*a* and 30*b*, each of the latching arms 22*a* and 22*b* includes a respective pair of release mechanisms 24*a* and 24*b*, each of which is mounted on respective opposite ends of the latching arms 22*a*, 22*b*. It should be appreciated, however, that fork 20 may be configured to hold more than two bags 30*a*, 30*b* and that the lifting straps 31*a*, 31*b* could be replaced with alternative devices enabling the fork 20 to hold bags or containers 30*a*, 30*b* in suspension. It is further envisioned that the release mechanisms 24*a*, 24*b* may include power-actuated jaws for selectively holding and releasing respective bags 30*a*, 30*b*. To provide support for bags or containers 30*a*, 30*b*, there are four release mechanisms 24*a* per pair of first latching arms 22*a* at the first end 20*a*, and four release mechanisms per pair of latching arms 22*b* at the second end 20*b*. It should be understood, however, that the number, type, and arrangement of release mechanisms 24*a*, 24*b* may vary while remaining within the scope of the present invention. Additionally, it should be appreciated that a person ordinary skilled in the art may adopt other forms, mechanisms, and/or structures that could serve the purpose and functionality of the release mechanisms 24*a*, 24*b*.

As best shown in FIGS. 1 and 4, each end 20*a* and 20*b* of multi-bag support fork 20 further supports a respective generally horizontal plate 26*a* and 26*b*. Each plate 26*a* and 26*b* has a generally centrally positioned opening surrounded by a respective hollow neck member 27*a* or 27*b* (FIG. 3). Respective hollow lower spouts 28*a* and 28*b* extend downwardly from the plates 26*a* and 26*b* such that neck members 27*a*, 27*b* are in fluid communication with respective lower spouts 28*a*, 28*b* through their respective openings. Optionally, and as best shown in FIG. 3, lower spout 28*a* and/or 28*b* includes a generally rigid spout portion 29 and a flexible spout portion 33 extending below rigid spout portion 29. Rigid spout portion 29 and flexible spout portion 33 may be attached to one another by attachment structure 25, such as screws, rivets, adhesives, staples, clamps, or other fasteners.

Referring now to FIGS. 1 and 4, frame 32 includes a first pair of generally upright posts, beams, or members 34*a* and a second pair of generally upright posts, beams, or members 34*b*. The posts 34*a*, 34*b* have respective foot portions 36 located at the lower ends of the posts 34*a*, 34*b* for supporting frame 32 on a suitable base, such as a floor, ground or the like. Top ends of first posts 34*a* are coupled together by a first cross-beam 38*a*. Similarly, top ends of second posts 34*b* are coupled together by a second cross-beam 38*b*. Frame 32 further includes a pair of I-beams 42 securely resting on top of the first and second cross-beams 38*a* and 38*b*, and in a generally perpendicular orientation to the cross-beams 38*a* and 38*b*. Although the illustrated embodiment depicts the I-beams 42 as a pair of generally parallel structural beams or bars, various structural configurations of beams or other structural supports are also envisioned within the scope of the present invention. Frame 32 additionally includes an auxiliary beam 40 positioned below and parallel to first cross-beam 38*a*. Similar to first cross-beam 38*a*, auxiliary beam 40 connects the pair of first posts 34*a*. It should be understood that frame 32 is a rigid support structure made up of structural elements which are connected in any suitable manner, such as by welding, rivets, or bolts.

Figure 1A:
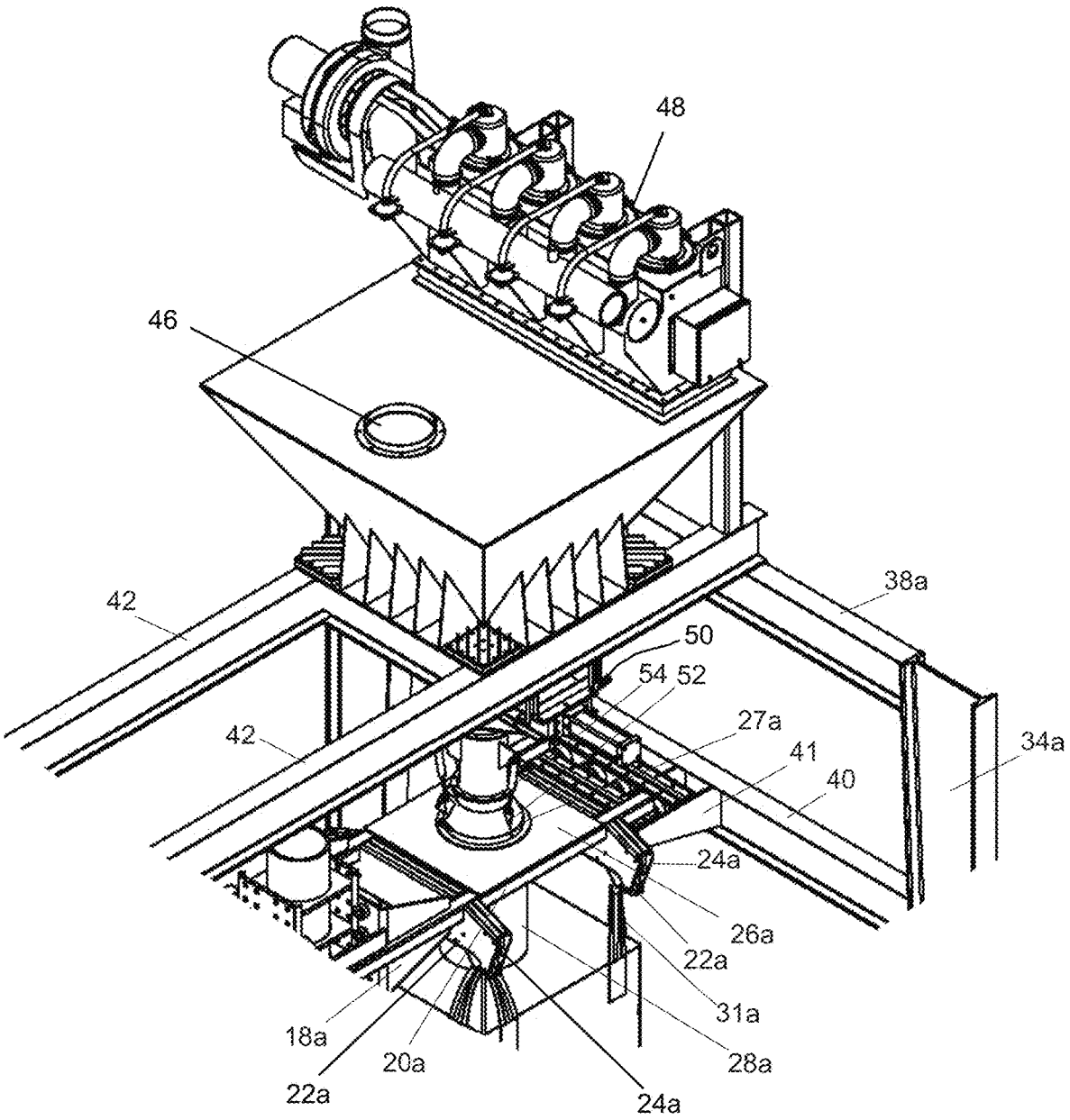
FIG. 1A is an enlarged view of the area designated 1A in FIG. 1.

As best shown in FIG. 1A, a cantilever 41 is attached to auxiliary beam 40 and extends generally parallel to the floor and in the direction of the post 14. Cantilever 41 is used as an additional support to prop the first end 20*a* of multi-bag support fork 20 when first bag 30*a* supported by the first end 20*a* is in the filling position. Optionally, as best seen in FIG. 3, auxiliary beam 40 supports a blower or fan 68 that may be used to fully open or inflate the bulk bag 30*a* suspended under batching hopper 44 prior to dispensing of the bulk material into the bulk bag. For example, blower 68 may be used to direct a flow of air though a duct (not shown) and downwardly into the open upper end of the bulk bag 30*a*. This ensures that the bag has assumed an unrestricted opening profile for proper bag filling with bulk material, in the event that the bag remains partially folded or collapsed when initially supported on the multi-bag support fork 20.

Batching hopper 44 is configured for receiving and temporarily storing the bulk material prior to dispensing of the bulk material into bulk bags 30*a* or 30*b*. The batching hopper 44 is supported on top of pair of I-beams 42 of frame 32. Batching hopper 44 includes an infeed arrangement or an opening 46 and a bottom opening 49 (FIG. 3), and has generally the shape of a funnel extending from the infeed opening 46 and the bottom opening 49. Batching hopper 44 may be of any construction known in the art and may incorporate any suitable material allowing for safe storage, or temporary holding and disposal of intended bulk materials. Batching hopper 44 optionally incorporates a weight scale so that batching hopper 44 serves as a weighing bin for measuring a predetermined quantity of bulk material to be dispensed. The weight scale may include a controller communicatively connected to a programmable logic controller (PLC). The controller is configured to transmit to the PLC the weight information of a batch of the bulk material prior to dispensing it, as well as the weight information of the empty batching hopper 44 so that the PLC can determine when batching hopper is empty. The function and operation of such controllers may be more fully understood with reference to commonly-owned U.S. Pat. No. 9,010,382, which is hereby incorporated herein by reference in its entirety.

With reference to FIGS. 1A and 4, a dust collector 48 collects airborne particles of the bulk material, and returns the particles back into batching hopper 44 while venting filtered air having reduced particle content. In the illustrated embodiment, the dust collector 48 is positioned on top of batching hopper 44. However, other arrangements and positioning of the dust collector 48 with respect to batching hopper 44 are envisioned.

Batching hopper 44 additionally includes a power-actuated slide gate 50 (FIG. 1A) in fluid communication with the lower opening 49 (FIG. 3) of batching hopper 44. Slide gate 50 is configured to selectively and quickly dispense the bulk material into an open upper end of the first bulk bag 30*a* that is positioned directly below the batching hopper 44. The slide gate 50 may be actuatable via a double-acting cylinder or linear actuator such as a pneumatically or hydraulically-actuated cylinder that operates in response to pressurized fluid (e.g. air or hydraulic fluid) to open and close slide gate 50 so that the bulk material can be selectively dispensed via gravity. Other means of power controlling the slide gate 50 are also envisioned within the scope of the present invention.

When the slide gate 50 is open, batching hopper 44 is in fluid communication with a fill spout assembly 52 extending downwardly from slide gate 50. As best seen in FIG. 1A, fill spout assembly 52 is a power-actuated, vertically retractable spout that engages and seals to neck member 27*a* or 27*b* in response to a command from the PLC indicating that a batch of bulk material is to be dispensed. In the illustrated embodiment, a plurality of actuators 54 control retractable motion of fill spout assembly 52. Actuators 54 may be electrically or mechanically driven. Also, engagement of neck members 27*a* or 27*b* by fill spout assembly 52 enables batching hopper 44 to be in selective fluid communication with bag 30*a* or 30*b*, respectively, whereby the bulk material contained in batching hopper 44 travels downward due to its own weight through slide gate 50 (when opened), fill spout assembly 52, lower spout 28*a* or 28*b* and into bag 30*a* or 30*b* to be filled with the bulk material.

Figure 2:
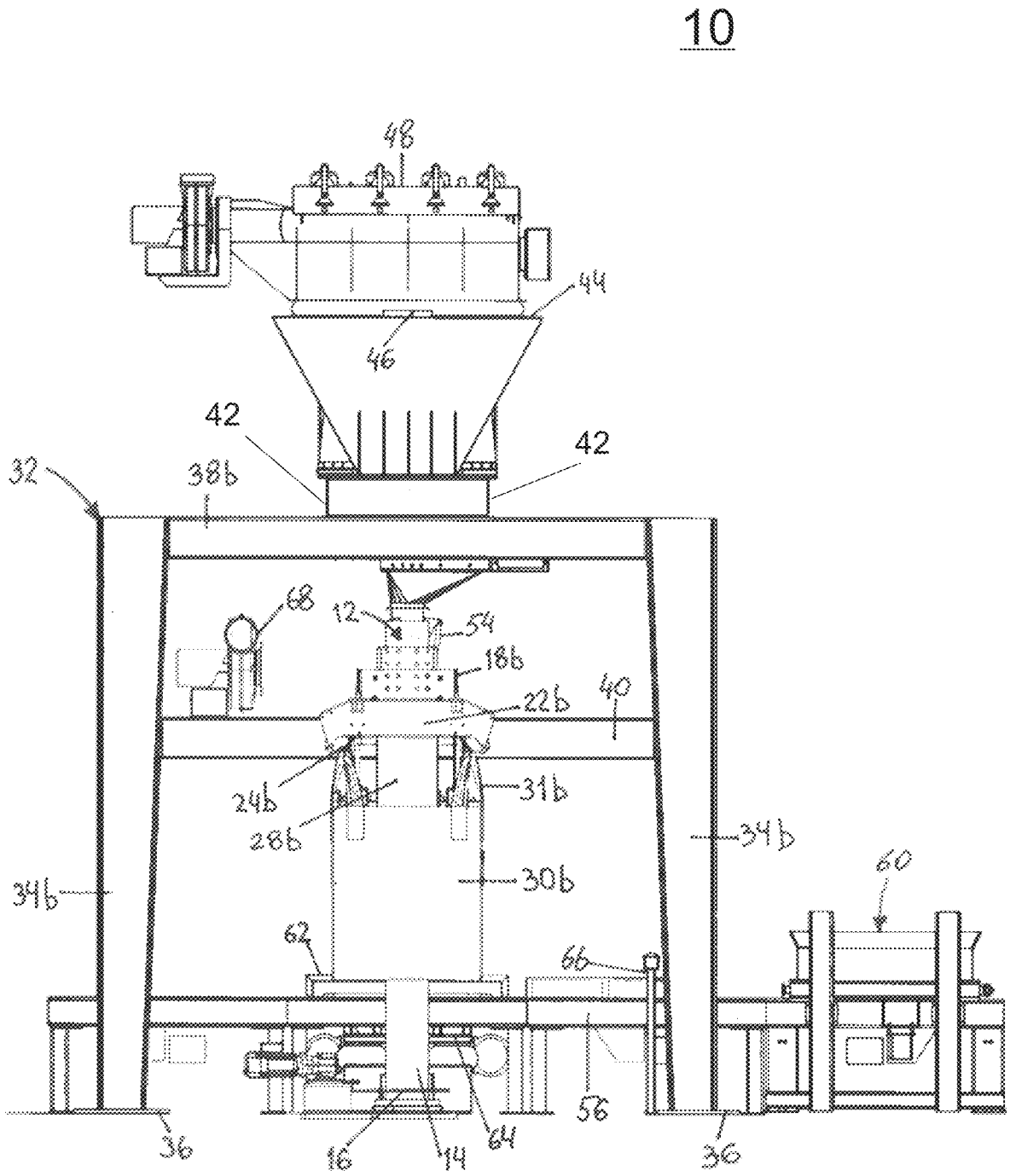
FIG. 2 is a side elevation of the apparatus illustrated in FIG. 1.

Turning attention now to FIGS. 1 and 2, roller deck or conveyor system 56 includes a pallet loader 60, a container-filling station 62, a pallet dispenser (not shown), a retractable vibrating grid 64 for densifying the bulk material dispensed into the bulk bags 30*a*, 30*b*, and a roller conveyor 58 for transporting the filled bulk bags or other containers 30*a*, 30*b* away from the container-filling station 62 and moving an empty pallet 63 from pallet loader 60. The vibrating grid 64 may include a timer control communicatively connected to the PLC.

The conveyor system 56 may be a roller conveyor, as shown in FIGS. 1 and 4, or it may be a belt conveyor, or an overhead rail-type conveyor for supporting and transporting a filled bulk bag away from container-filling station 62. When conveyor system 56 is configured as a roller conveyor, it may be desirable to provide individual pallets 63 for supporting individual bulk bags upon the roller conveyor 58, such as shown in FIGS. 1 and 4. Once a filled bulk bag has been rolled away from container-filling station 62 by the roller deck 56, the filled bulk bag may be carried away on pallets 63, such as by a fork lift, or picked up by its lifting straps and hauled away from filling machine 10 for storage or use. Filling machine 10 may further include a pair of activation switches 66 located at an operator's station of the machine 10. Although in the illustrated embodiment dual activation switches 66 are shown, other safety switches to operate filling machine 10 are contemplated within the scope of the present invention.

Bags 30*a* and 30*b* are generally large container bags, such as a flexible bulk container that is commonly used for transporting dry, flowable products, such as sand, fertilizer, granules of plastic, and etc. Such bags are typically made of reinforced, flexible polymeric materials, such as thick woven polyethylene or polypropylene, either coated or uncoated, and include integral or sewn-on lifting straps. However, it will be appreciated that rigid or semi-rigid containers may also be supported and filled by the filling machine 10.

Optionally, the container-filling station 62 includes an auxiliary weight scale including a controller communicatively connected to PLC. The controller is configured to transmit to the PLC the weight information of the batch of the bulk material actually dispensed into the bulk bag 30*a* or 30*b*. The PLC may then compare the weight of the batch of the bulk material weighed while in batching hopper 44 prior to dispensing with the weight of the bulk material in bulk bag 30*a* or 30*b* to determine if any loss of material has occurred during the dispensing process, or if the weight scales or other electronic equipment of the filling machine 10 require calibration or repair.

The filling machine 10 may include a data recorder (not shown) for recording data pertaining to the filling operation, including data about contents of each bulk bag, and the PLC for controlling the operation of the filling machine 10. For example, the data recorder and PLC may be configured to control the actuation of the slide gate 50, to raise and lower fill spout assembly 52, and to measure specific quantities of bulk material to be dispensed from the batching hopper 44. Data recorder and PLC may receive data pertaining to the contents of each bulk bag, including the amount and/or weight ratio of each bulk material that has been added to each bulk bag or other container, and the bag's final weight, as reported by the auxiliary weigh scale. Optionally, the amount of each bulk material may be expressed in terms of weight, volume, or other measurable criteria (e.g., mole), and the ratio of one material to another may be expressed in terms of weight ratio, volume ratio, molar ratio (such as for chemical compounds), or the like.

The data recorder and PLC may be substantially any electronic or electrical device capable of carrying out control algorithms, such as in a computer or microprocessor, and may include a control input device (such as a key pad or a touch screen, or the like), a display, and a printer, or other data output device. Thus, the data recorder and PLC provide some or all of the controlling functions of the filling machine 10, which may include operation of the multi-bag support assembly 12 including its speed of rotation and rotation parameters, batching hopper 44, the slide gate 50, the roller conveyor 56, and the weight scale(s) incorporated either in the batching hopper 44 and/or in the roller deck 56.

The data recorder and PLC are further operable to record and transfer or print data pertaining to the contents of the filled bulk bag. The data recorder and PLC may be preprogrammed to fill the bulk bag with predetermined quantities of bulk materials such that an operator using the data recorder and controller may simply select a desired composition for the contents of the bulk bags and permit the data recorder and PLC to control the various components of the filling machine 10, particularly actuatable members of filling machine 10 during its operation to achieve the desired results. The printer may be used to output a printed record of the contents of each filled bulk bag, which can be affixed to each filled bulk bag for ease of reference prior to use of the bulk bag's contents.

Filling machine 10 is used or operated by first suspending the first bag 30*a* by its straps 31*a* from the first end 20*a* of the multi-bag support fork 20. Using dual activation switches 66 to ensure that the operator remains fully clear of moving components, the operator triggers rotation of multi-bag support assembly 20 such that first bag 30*a* rotates to container-filling station 62 (the fill position) under batching hopper 44. Once at the filling station 62, the vibrating grid 64 lifts, the fill spout assembly 52 engages neck member 27*a* and, in response to a command from the PLC, slide gate 50 opens to dispense a batch of the bulk material. In the meantime, the operator may install an empty second bulk bag 30*b* by suspending the second bag 30*b* by its straps 31*b* from the second end 20*b* that is at the operator's station after the first bag 30*a* had been rotated to the fill station 62. In response to a command from the PLC, gate 50 closes. Closing of gate 50 may occur, for example, as a result of the weight scale inside hopper 44 indicating that hopper 44 is empty. Once the vibrating grid 64 times out, roller conveyor 58 moves the filled bag 30*a* out of filling station 62 and moves an empty pallet 63 into the filling station 62. Using activation switches 66, the operator triggers rotation of multi-bag support assembly 20 such that the second bag 30*b* rotates to container-filling station 62 under batching hopper 44, and the now-empty latching arms 22*b* can receive the straps of another empty bulk bag. The steps described above in this paragraph are repeated by the operator to maintain a substantially uninterrupted and continuous process of filling multiple bags or containers with bulk material.

Although the two-fork support arrangement that is shown and described herein may provide sufficient operational speed, variations are envisioned that may further improve operational speed or efficiency. For example, an automated bag loader may be utilized to obviate the need for manual loading of empty bags. Optionally, the post 14 may be fitted with a three-fork or four-fork bag support assembly to allow for two or three of the forks to be loaded with empty bags while the third or fourth fork is supporting a bag being filled with bulk material, or to allow the bag support assembly to dispense filled bags to two or more different filling stations and/or conveyors lending to different locations.

Accordingly, the filling machine 10 provides a substantially self-contained container-filling facility for filling or loading bulk bags or other containers with different bulk materials in an efficient and high speed manner, in which filled bags are readily transported to a convenient location for later use. This is accomplished by the filling machine having a batching hopper capable of receiving and dispensing a variety of bulk materials into various bags or containers suspended from the multi-bag support assembly, which rotates to position an empty bulk bag or container suspended from one of its ends at the filling station to be filled with a desired bulk material.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. An apparatus for filling a container with bulk material, the apparatus comprising:

a bulk material supply structure having an outlet;

a multi-container support assembly comprising:

an upright rotary structure configured to rotate about an axis; and a multi-container support coupled to said rotary structure and having first and second end portions configured to support respective first and second bulk material containers, said end portions defining respective openings; and a fill spout assembly having a vertically retractable spout extending downwardly beneath said outlet of said bulk material supply structure, for directing the bulk material into the first or second container;

wherein said multi-container support assembly is rotatable by said rotary structure such that the first and second containers are selectively positionable under said bulk material supply structure to receive a bulk material via said outlet; and wherein said vertically retractable spout is downwardly extendable relative to said outlet and said multi-container support to engage one of said end portions of said multi-container support at its opening during a filling operation through said opening, and upwardly retractable to disengage said multi-container support between filling operations.

2. The apparatus of claim 1, wherein said rotary structure comprises a rotational drive system including a drive sprocket.

3. The apparatus of claim 1, wherein said vertically retractable spout is power-actuated.

4. The apparatus of claim 1, wherein said bulk material supply structure comprises a batching hopper configured to weigh a batch of the bulk material prior to dispensing the bulk material into the first or second container.

5. The apparatus of claim 4, wherein said batching hopper includes a sensor configured to transmit weight information of said batching hopper to a programmable logic controller (PLC).

6. The apparatus of claim 5, wherein said batching hopper further comprises an actuatable closure controlled by the PLC to selectively dispense the bulk material into the first or second container.

7. The apparatus of claim 1, wherein said multi-container support assembly further comprises a multi-container support fork having first and second opposite end portions at opposite sides of said rotary structure.

8. The apparatus of claim 7, wherein said first and second end portions of said multi-container support fork are parallel to each other.

9. The apparatus of claim 8, wherein each of said first and second end portions of said multi-container support comprises a pair of latching arms, each of said latching arms having a pair of opposite release mechanisms configured to selectively hold and release the first or second bulk material container.

10. The apparatus of claim 9, wherein each of said release mechanisms comprises power-actuated jaws controlled by a programmable logic controller (PLC) to selectively hold and release the first or second containers.

11. A method for filling a container with a bulk material, said method comprising:

filling a batching hopper with a batch of bulk material;

installing a first container at a first end of a multi-container support assembly, with the first end in a container-loading position;

rotating the multi-container support assembly to position the first container in a container-filling position under the batching hopper;

lowering a retractable fill spout into engagement with a neck member of the multi-container support assembly;

dispensing the batch of bulk material through the fill spout and neck member, and into the first container;

raising the retractable fill spout to disengage the retractable fill spout from the neck member;

installing a second container at a second end of the multi-container support assembly, with the second end in the container-loading position and with the first end in the container-filling position;

discharging the first container from the first end; and rotating the multi-container support assembly to position the second container in the container-filling position.

12. The method of claim 11, wherein said dispensing the batch of bulk material into the first container is followed by automatically lifting a vibrating grid of a roller deck to vibrate the batch of bulk material in the first container.

13. The method of claim 11, wherein said lowering the fill spout comprises automatically aligning and sealing the fill spout to the neck member of the multi-container support assembly.

14. The method of claim 13, wherein said dispensing the batch of bulk material into the first container is preceded by weighing the batch of bulk material in the batching hopper and opening an actuatable closure to selectively dispense the batch of bulk material into the first container.

15. The method of claim 14, further comprising weighing the batching hopper without any bulk material in the batching hopper and, in response to an indication that the batching hopper is empty, closing the actuatable closure, wherein the indication is an electronic signal transmitted from the batching hopper to a programmable logic controller (PLC).

16. The method of claim 15, wherein said lowering the fill spout, said weighing the batch of bulk material, and said opening and closing the actuatable closure are all controlled by the PLC.

17. The method of claim 11, wherein said discharging the first container from the container-filling position comprises releasing the first container from the multi-container support assembly onto a pallet, transferring the first container away from the container-filling position, and placing an empty pallet in the container-filling position under the batching hopper.

18. The method of claim 17, further comprising:

filling the batching hopper with an additional batch of bulk material;

rotating the multi-container support assembly to position the second container on the empty pallet in the container-filling position;

lowering and engaging the fill spout to direct the additional batch of bulk material into the second container;

installing a third container at the first end of the multi-container support assembly;

opening an actuatable closure to selectively dispense the additional batch of bulk material into the second container;

dispensing the additional batch of bulk material into the second container;

discharging the second container from the second end of the multi-container support assembly in the container-filling position; and rotating the multi-container support assembly to position the third container in the container-filling position.

19. The method of claim 18, wherein said opening the actuatable closure is preceded by weighing the additional batch of bulk material in the batching hopper.

20. The method of claim 18, wherein said rotating to position the second and third containers in the container-filling position comprises rotating the multi-container support assembly 180 degrees about a longitudinal axis of a rotary structure of the multi-container support assembly.

* * * * *